US008852360B2

(12) United States Patent
Tanahashi et al.

(10) Patent No.: US 8,852,360 B2
(45) Date of Patent: Oct. 7, 2014

(54) HIGH STRENGTH HOT-ROLLED STEEL PLATE EXHIBITING EXCELLENT ACID PICKLING PROPERTY, CHEMICAL CONVERSION PROCESSABILITY, FATIGUE PROPERTY, STRETCH FLANGEABILITY, AND RESISTANCE TO SURFACE DETERIORATION DURING MOLDING, AND HAVING ISOTROPIC STRENGTH AND DUCTILITY

(75) Inventors: Hiroyuki Tanahashi, Tokyo (JP); Shinya Saitoh, Tokyo (JP); Masashi Fukuda, Tokyo (JP); Hiroyuki Okada, Tokyo (JP); Kunio Hayashi, Tokyo (JP); Toshimasa Tomokiyo, Tokyo (JP); Nobuhiro Fujita, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 141 days.

(21) Appl. No.: 13/509,946

(22) PCT Filed: Nov. 16, 2010

(86) PCT No.: PCT/JP2010/070346
§ 371 (c)(1), (2), (4) Date: Jul. 12, 2012

(87) PCT Pub. No.: WO2011/062151
PCT Pub. Date: May 26, 2011

(65) Prior Publication Data

US 2012/0279620 A1 Nov. 8, 2012

(30) Foreign Application Priority Data

Nov. 18, 2009 (JP) ..... P2009-263268

(51) Int. Cl.

| | |
|---|---|
| ***C22C 38/02*** | (2006.01) |
| ***C22C 38/04*** | (2006.01) |
| ***C22C 38/06*** | (2006.01) |
| ***C23C 2/02*** | (2006.01) |
| ***C22C 38/12*** | (2006.01) |
| ***C23C 2/06*** | (2006.01) |
| ***C21D 9/46*** | (2006.01) |
| ***C22C 38/00*** | (2006.01) |
| ***C22C 38/14*** | (2006.01) |

(52) U.S. Cl.

CPC . *C23C 2/06* (2013.01); *C22C 38/12* (2013.01); *C22C 38/04* (2013.01); *C21D 9/46* (2013.01); *C21D 2211/001* (2013.01); *C22C 38/06* (2013.01); *C21D 2211/005* (2013.01); *C22C 38/02* (2013.01); *C22C 38/001* (2013.01); *C22C 38/14* (2013.01); *C21D 2211/008* (2013.01)

USPC ..... 148/320; 420/103; 420/120

(58) Field of Classification Search

CPC ..... C22C 38/02; C22C 38/04; C22C 38/06
USPC ..... 148/320, 333–336; 420/103
See application file for complete search history.

(56) References Cited

FOREIGN PATENT DOCUMENTS

| | | | |
|---|---|---|---|
| JP | 2005-139486 | A | 6/2005 |
| JP | 2006-316301 | A | 11/2006 |
| JP | 2007-211334 | A | 8/2007 |
| JP | 2007-327098 | A | 12/2007 |
| JP | 2009-263268 | A | 11/2009 |
| JP | 2009-270171 | A | 11/2009 |

(Continued)

OTHER PUBLICATIONS

Machine-English translation of Japanese patent No. 2006-316301, Kikuchi Sukehisa, Nov. 24, 2006.*

International Search Report, dated Feb. 22, 2011, issued in PCT/JP2010/070346.

Nomura et al., "Development of High Strength Cold-rolled Steel Sheets with Excellent Phosphatability", Research and Development, Kobe Steel Engineering Reports, vol. 57, No. 2, pp. 74-77, Aug. 2007.

Korean Notice of Decision to Grant dated Mar. 28, 2014 for Application No. 10-2012-7012458.(with English translation).

* cited by examiner

*Primary Examiner* — Deborah Yee
(74) *Attorney, Agent, or Firm* — Birch, Stewart, Kolasch & Birch, LLP

(57) ABSTRACT

This high strength hot-rolled steel sheet includes: in terms of percent by mass, C: 0.05 to 0.12%; Si: 0.8 to 1.2%; Mn: 1.6 to 2.2%; Al: 0.30 to 0.6%; P: 0.05% or less; S: 0.005% or less; and N: 0.01% or less, with the remainder being Fe and unavoidable impurities, wherein a microstructure includes specific ranges (in area %) of ferrite phases as well as martensite phases, and a maximum concentration of Al detected by a glow discharge emission spectroscopic analysis is in a range of 0.75 mass % or less in a region from a surface of the steel sheet to a thickness of 500 nm after being acid-pickled.

6 Claims, 1 Drawing Sheet

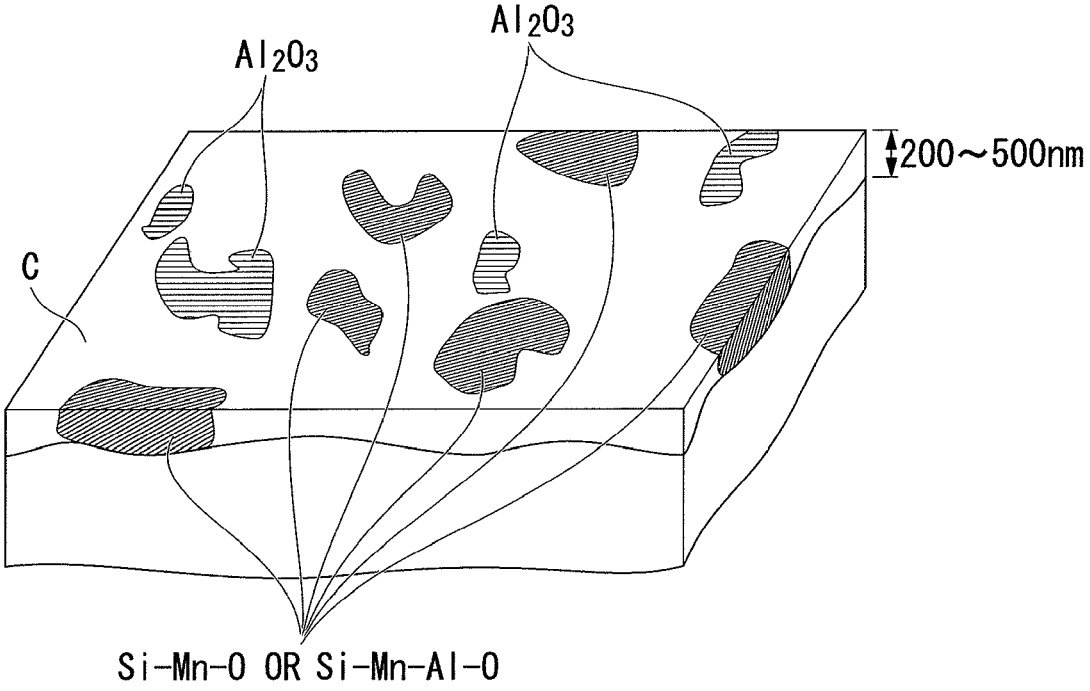
$Al_2O_3$
$Al_2O_3$
200~500nm
C
Si-Mn-O OR Si-Mn-Al-O

HIGH STRENGTH HOT-ROLLED STEEL PLATE EXHIBITING EXCELLENT ACID PICKLING PROPERTY, CHEMICAL CONVERSION PROCESSABILITY, FATIGUE PROPERTY, STRETCH FLANGEABILITY, AND RESISTANCE TO SURFACE DETERIORATION DURING MOLDING, AND HAVING ISOTROPIC STRENGTH AND DUCTILITY

TECHNICAL FIELD

The present invention relates to a high strength hot-rolled steel sheet that is suitably used to a component of a transport machine such as an automobile, and particularly has a tensile strength of 780 MPa or more, and a method for producing the same.

The present application claims priority on Japanese Patent Application No. 2009-263268 filed on Nov. 18, 2009, the content of which is incorporated herein by reference.

BACKGROUND ART

According to a recent demand of society, a mass-reduction is strongly demanded in transport machines such as automobiles. A lot of steel sheets are used in the transport machines such as automobiles, and a use of high-strength materials for exterior sheets (body) or skeleton members is proceeded so as to fulfill the demand for mass-reduction. Hot-rolled steel sheets are used for underbody components such as arms and wheel disks. With regard to these underbody components, there is a concern of an effect on ride quality due to a decrease in rigidity; and therefore, thinning through high strengthening has not been positively examined.

However, since the demand for the mass-reduction has further increased, this demand is also made without exception to the underbody components. For example, the upper limit of the tensile strength of the hot-rolled steel sheet that is used in the related art is 590 MPa class; however, a use of steel sheets of 780 MPa class begins to be examined. Under this circumstance, a fatigue property and a corrosion resistance are required for the steel sheet in addition to a formability that commensurates with the strength.

With regard to the corrosion resistance among these properties, a steel sheet having a sufficient sheet thickness is used to secure rigidity in the related art. Therefore, even when the sheet thickness is reduced due to corrosion, an effect on properties of the components is small, and the corrosion resistance of the steel sheet is not seen as a problem. However, as described above, the thinning of a component has been directed, and a corrosion allowance to allow the reduction in sheet thickness due to corrosion has been reduced. Here, the corrosion allowance is a thickness that is enlarged in design in consideration of the amount of metal reduction due to corrosion during usage. In addition, simplification of chemical conversion processing and coating is considered to reduce a manufacturing cost. Therefore, it is necessary to pay more attention to a property or state in a surface of a steel material as compared to the related art.

When a hot-rolled steel sheet is applied to the underbody component, the hot-rolled steel sheet is shipped after being acid-pickled and coated with oil. Thereafter, the hot-rolled steel sheet is processed into components, and then the processed steel sheet is subjected to a chemical conversion processing and a coating process in many cases. Among properties of the hot-rolled steel sheet which are required for these treatment processes, particularly, a chemical conversion processability is most affected by the property and the state in the surface of the steel sheet, and has a great effect on the corrosion resistance.

In addition, since stress is repeatedly applied to strength members such as the underbody components, a fatigue property is required for the hot-rolled steel sheet.

Furthermore, since a sheared end portion is processed in many cases, a stretch flangeability (stretch-flange formability), that is, a hole expandability is also required for the hot-rolled steel sheet in many cases.

In addition to these, isotropy in properties of the material (hot-rolled steel sheet) during processing is gradually treated as important. In the case where anisotropy in a press formability or the like is small, a degree of freedom of collecting a blank for forming becomes high; and therefore, an improvement in a yield rate may be expected.

Since a remaining portion of the steel sheet after the blank for forming is collected is treated as a waste, it is necessary to allocate the blank so as to reduce the generation of the waste as much as possible. However, in the case where the anisotropy is present in the formability of the steel sheet, when a direction (for example, a more largely stretched (elongated) direction) of a component, in which a forming condition is strict, is allocated to a direction in which the formability (for example, stretch property (elongation property)) is inferior, an occurrence ratio of defects during forming becomes high. Therefore, the allocation direction of the blank is restricted. As a result, a yield ratio (smallness in an amount of generated waste) deteriorates as compared to a case in which the restriction is not present. This situation is reflected in the reason why the steel sheet having isotropic properties is preferred.

Suppression of occurrence of surface deterioration during forming is one of the properties to be required, and a countermeasure thereof is also demanded.

The surface deterioration is one of defects that are observed in a portion of the component after being press-molded, and it is well known that this is due to a minute unevenness. As one of the well-known methods for suppressing the surface deterioration, it is effective to make lengths of crystal grains of the material in a surface layer not be excessively large in a rolling direction.

An acid pickling property of the hot-rolled steel sheet is also gradually treated as important. In an acid-pickled surface (property and state of a surface after the acid pickling) of the hot-rolled steel sheet, the same smoothness as a cold-rolled steel sheet has not been required in the related art. However, consumer needs and the like vary, and there occurs a tendency that it is strongly preferred to make the surface as smooth as possible.

The smoothness of the acid-pickled surface is improved by lowering a concentration of hydrochloric acid in a hydrochloric acid aqueous solution that is used in the acid pickling and a temperature thereof. However, productivity decreases under the condition thereof; and therefore, a hot-rolled steel sheet having an acid pickling property superior to a steel sheet that is obtained until now is desirable.

Many technologies have been proposed which improve a fatigue property and a stretch flangeability of the steel sheet, and the present inventors also have promoted a research to optimize chemical components and a microstructure of the steel sheet.

On the other hand, the chemical conversion processability of the steel sheet depends on a Si content of the steel sheet, and it is well-known that the more the Si content is, the more inferior the chemical conversion processability becomes.

However, in the case where the steel sheet is highly strengthened by making Si be solid-solubilized in ferrite phases, a deterioration amount of ductility is not remarkably large. Therefore, Si is an element that is preferred to be used as much as possible in the manufacturing of the high-strength steel sheet. In addition, particularly, in the case where a steel sheet having both of high ductility and high strength is manufactured by combining the ferrite phases and hard phases such as martensite phases, Si is an element effective to secure a predetermined fraction ratio of the ferrite phases.

As a method of responding to these contradicting demands, a technology in which a part of Si is substituted by Al is proposed (for example, Patent Document 1).

Patent Document 1 discloses a hot-rolled steel sheet having a high tensile strength which contains less than 1% of Si and 0.005 to 1.0% of Al, and a method of producing the same. However, the production method disclosed in Patent Document 1 includes a process of heating a rough bar (a rough rolled material). The production method premised on the heating of the rough rolled material is special. As a result, there is a problem in that only limited business operators can execute the production method.

In general, facilities used in the process of producing the hot-rolled steel sheet include a heating furnace, a roughing mill, a descaling device, a finishing mill, a cooling device, and a coiler. Each of the respective facilities is disposed at an optimal position. Therefore, even when the advantage of heating the rough rolled material is wanted to be obtained, there is no space to provide a new facility, or a lot of modification on the facilities is necessary. As a result, the heating of the rough rolled material is not generalized yet. In addition, there is no description with respect to the chemical conversion properties of the steel sheet that is obtained by the technology disclosed in Patent Document 1.

On the other hand, Patent Document 2 discloses a hot-rolled steel sheet that contains Si and Al and is superior in the chemical conversion processability, and a method of producing the same.

However, in Patent Document 2, the upper limit of an Al content is specified to 0.1%, and it is described that in the case where the Al content exceeds this upper limit, the corrosion resistance deteriorates although the reason is not clear.

As described above, a hot-rolled steel sheet that contains at least 0.3% or more of Al together with Si and that is superior in the chemical conversion processability, and a method of producing the same are not found.

PRIOR ART DOCUMENT

Patent Document

Patent Document 1: Japanese Unexamined Patent Application, First Publication No. 2006-316301

Patent Document 2: Japanese Unexamined Patent Application, First Publication No. 2005-139486

Non-Patent Document

Non-Patent Document 1: M. Nomura, I. Hashimoto, M. Kamura, S. Kozuma, Y. Omiya: Research and Development, Kobe Steel Engineering Reports, Vol. 57, No. 2 (2007), 74 to 77

DISCLOSURE OF THE INVENTION

Problems to be Solved by the Invention

The present invention has been made in consideration of these circumstances, and the invention aims to provide a high strength hot-rolled steel sheet that is superior in an acid pickling property, a chemical conversion processability, a fatigue property, a hole expandability, and a resistance to surface deterioration during forming, and that has isotropic strength and isotropic ductility, and a method for producing the hot-rolled steel sheet.

Means for Solving the Problems

The present inventors selected a DP steel sheet in which ferrite phases and martensite phases are combined as a steel sheet superior in a fatigue property, and they changed chemical components and production conditions extensively, and then mechanical properties and a chemical conversion processability were evaluated. As a result, they found that in the case where a Si content and an Al content are controlled and combined within appropriate ranges, a steel sheet is obtained that is superior in not only the mechanical properties but also the acid pickling property, the chemical conversion processability, and the resistance to surface deterioration, and they accomplished the invention.

There is provided a high strength hot-rolled steel sheet according to an aspect of the invention that is superior in an acid pickling property, a chemical conversion processability, a fatigue property, a hole expandability, and a resistance to surface deterioration during forming, and that has isotropic strength and isotropic ductility, and the steel sheet includes: in terms of percent by mass, C: 0.05 to 0.12%; Si: 0.8 to 1.2%; Mn: 1.6 to 2.2%; Al: 0.30 to 0.6%; P: 0.05% or less; S: 0.005% or less; and N: 0.01% or less, with the remainder being Fe and unavoidable impurities, wherein a microstructure includes: 60 area % or more of ferrite phases; more than 10 area % of martensite phases; and 0 to less than 1 area % of residual austenite phases, or the microstructure includes: 60 area % or more of ferrite phases; more than 10 area % of martensite phases; less than 5 area % of bainite phases; and 0 to less than 1% of residual austenite phases, and a maximum concentration of Al detected by a glow discharge emission spectroscopic analysis is in a range of 0.75 mass % or less in a region from a surface of the steel sheet to a thickness of 500 nm after being acid-pickled.

In the high strength hot-rolled steel sheet according to the aspect of the invention, that is superior in an acid pickling property, a chemical conversion processability, a fatigue property, a hole expandability, and a resistance to surface deterioration during forming, and that has isotropic strength and isotropic ductility, the steel sheet may further include, in terms of percent by mass, one or more selected from a group consisting of Cu: 0.002 to 2.0%, Ni: 0.002 to 1.0%, Ti: 0.001 to 0.5%, Nb: 0.001 to 0.5%, Mo: 0.002 to 1.0%, V: 0.002 to 0.2%, Cr: 0.002 to 1.0%, Zr: 0.002 to 0.2%, Ca: 0.0005 to 0.0050%, REM: 0.0005 to 0.0200%, and B: 0.0002 to 0.0030%.

An average length of a ferrite crystal grain in a rolling direction may be in a range of 20 μm or less in a region from the surface of the steel sheet to a thickness of 20 μm.

There is provided a method for producing a high strength hot-rolled steel sheet according to an aspect of the invention that is superior in an acid pickling property, a chemical conversion processability, a fatigue property, a hole expandability, and a resistance to surface deterioration during forming, and that has isotropic strength and isotropic ductility, and the method includes: a process of heating a slab at a heating temperature in a range of T1 or less and subjecting the slab to rough rolling under conditions in which a rolling reduction ratio is in a range of 80% or more and a final temperature is in a range of T2 or less to produce a rough rolled material; a process of subjecting the rough rolled material to descaling and subsequent finish rolling under a condition in which a finish temperature is set to be in a range of 700 to 950° C. to produce a rolled sheet; a process of cooling the rolled sheet to a temperature in a range of 550 to 750° C. at an average cooling rate of 5 to 90° C./s, further cooling the rolled sheet to a temperature in a range of 450 to 700° C. at an average cooling rate of 15° C./s or less, and further cooling the rolled sheet to a temperature in a range of 250° C. or less at an average cooling rate of 30° C./s or more to produce a hot-rolled steel sheet; and a process of coiling the hot-rolled steel sheet, wherein T1=1215+35×[Si]−70×[Al], T2=1070+35×[Si]−70×[Al], and [Si] and [Al] represent a Si content (mass %) in the slab, and an Al content (mass %) in the slab, respectively.

In the method for producing of a high strength hot-rolled steel sheet according to the aspect of the invention that is superior in an acid pickling property, a chemical conversion processability, a fatigue property, a hole expandability, and a resistance to surface deterioration during forming, and that has isotropic strength and isotropic ductility, in the process of subjecting the slab to the rough rolling, the heating temperature of the slab may be set to be in a range of less than 1200° C., and the final temperature of the rough rolling may be set to be in a range of 960° C. or less, and in the process of subjecting the rough rolled material to the finish rolling, the finish temperature may be set to be in a range of 700 to 900° C.

Effects of the Invention

In the hot-rolled steel sheet according to the aspect of the present invention, Si and Al are contained at suitable contents, and the hot-rolled steel sheet is produced under the above-mentioned conditions; and thereby, characteristics superior in mechanical properties and chemical conversion processability can be obtained. In particular, since a maximum concentration of Al is in a range of 0.75 mass % or less in a region from a surface of the steel sheet to a thickness of 500 nm after being acid-pickled, a ratio of oxides containing Al in the surface is low. As a result, the surface of the steel sheet is superior in a wettability of chemical conversion processing liquid; and therefore, superior chemical conversion processability can be obtained. In addition, since a descaling property and an acid pickling property are also superior, more excellent chemical conversion processability can be obtained. Therefore, a plating layer or a coating film that is superior in an adhesion property can be formed on the surface of the steel sheet; and thereby, a superior corrosion resistance can be realized. As a result, in the case where the hot-rolled steel sheet is plated or coated and then the hot-rolled steel sheet is applied to a component of a transport machine, a corrosion allowance can be reduced. Since the thickness of the steel sheet can be decreased, the steel sheet can contribute to a mass-reduction of the transport machine.

Since the appropriate content of Si is contained, a superior hole expandability can be obtained. Therefore, a restriction in a processing process is small and an applicable range of the hot-rolled steel sheet is wide.

The microstructure includes ferrite phases and martensite phases, and the area ratios of the respective phases are adjusted to the above-described appropriate values; and thereby, a tensile strength of 780 MPa or more, an elongation of 23% or more, and a fatigue limit ratio of 0.45 or more can be obtained. As described above, since the mechanical properties and the fatigue property are superior, the hot-rolled steel sheet can be applied to a member such as an underbody component to which stress is repeatedly applied.

In addition, anisotropy of the mechanical properties (strength and elongation) of the hot rolled steel sheet is small, and the mechanical properties are isotropic; and therefore, the collection of a blank during processing cab be performed with a good yield ratio.

As described above, a formability is superior; and therefore, the steel sheet can be processed into components having various shapes even when the steel sheet has a high strength.

Since the superior acid pickling property can be obtained, smooth property and state of the surface can be realized which corresponds to needs of consumers. In addition, since the property and state of the surface are superior, it is possible to simplify the chemical conversion process and coating. As a result, the manufacturing cost at the time of processing the hot-rolled steel sheet into a component can be reduced.

In addition, the average length of the ferrite crystal grains in the surface layer in the rolling direction is in a range of 20 μm or less; and therefore, the crystal grains in the surface layer is prevented from being too long in the rolling direction. As a result, the occurrence of the surface deterioration during forming can be suppressed.

In accordance with the method of producing the hot-rolled steel sheet according to the aspect of the present invention, the hot-rolled steel sheet can be produced which has the above-described superior properties. In particular, a heating temperature of a slab, a final temperature of a rough rolling, and a rolling reduction ratio are appropriately adjusted to the above-described values. Thereby, scales can be efficiently and sufficiently removed in the descaling process after the rough rolling. As a result, a hot-rolled steel sheet having a superior acid pickling property can be produced.

In addition, in the case where the heating temperature of the slab is set to be in a range of less than 1200° C. and the final temperature of the rough rolling is set to be in a range of 960° C. or less, an austenite grain size before the finish rolling is refined; and as a result, a hot-rolled steel sheet can be produced which is superior in a resistance to surface deterioration during forming.

In the case where the final temperature of the finish rolling is set to be in a range of 900° C. or less, a hot-rolled steel sheet can be produced which has isotropic strength and isotropic ductility.

BRIEF DESCRIPTION OF THE DRAWINGS

FIG. 1 is a schematic diagram illustrating a distribution of oxides in a surface of a steel sheet after being hot-rolled and acid-pickled.

BEST MODE FOR CARRYING OUT THE INVENTION

Upon completion of the present invention, the present inventors selected a DP steel sheet as a basic steel sheet, and the DP steel sheet is superior in a fatigue property. They performed experiments in which chemical components and production conditions were changed extensively, and evaluated mechanical properties and chemical conversion processability.

As a result thereof, they found that in the case where a Si content and a Al content are controlled within appropriate ranges and the production conditions are appropriately adjusted, a steel sheet is obtained which is superior in not only the mechanical properties but also the chemical conversion processability.

First, findings obtained through such a research will be specifically described. Here, in the following description, a unit in the content and concentration of a component element is mass %, and when not particularly described, the unit is expressed only by %.

Steels containing substantially 0.09% of C, 0.85 to 1.15% of Si, substantially 2% of Mn, 0.25 to 0.46% of Al, substantially 0.02% of P, substantially 0.002% of S, substantially 0.002% of N, and a remainder of Fe and unavoidable impurities were melted to produce slabs.

The obtained slabs were heated to 1130 to 1250° C., rough rolling was performed, and descaling was performed. Subsequently, finish rolling was performed under a condition where a finish temperature was set to 860° C. Subsequently, primary cooling was performed to 630° C. at an average cooling rate of 72° C./s, secondary cooling was performed to 593° C. at an average cooling rate of 8° C./s, third cooling was performed to 65° C. at an average cooling rate of 71° C./s, and coiling was performed to produce a hot-rolled steel sheet.

The steel sheet obtained as described above was acid-pickled, and then mechanical properties thereof were examined. As a result, superior properties in which strength was 780 MPa or more, elongation was 23% or more, and a fatigue limit ratio was 0.45 or more were obtained in substantially all the steel sheets.

On the other hand, with regard to an amount of phosphate coating that is an index of the chemical conversion processability, steel sheets were present of which amounts of phosphate coatings were 1.5 g/m$^2$ or more and which exhibited superior chemical conversion processability, and steel sheets were also present of which amounts of phosphate coatings were less than 1.5 g/m$^2$. Al contents of the steel sheets exhibiting the superior chemical conversion processability were in a range of 0.3% or more.

In Non-Patent Document 1, a high strength cold-rolled steel sheet is disclosed which is superior in chemical conversion processability, and ranges of a Si content and a Mn content are described where superior chemical conversion processability can be obtained, and an explanation of a mechanism thereof is attempted.

When Si contents and Mn contents of the above-described steel sheets obtained by the present inventors were applied to Non-Patent Document 1, the present inventors found that the Si contents and the Mn contents of all the steel sheets were within the ranges where the chemical conversion processability was evaluated as inferior. It was supposed that a difference between the description of Non-Patent Document 1 and the research result obtained by the present inventors was caused by a difference in the Al concentration between them.

Under these circumstances, a quantitative analysis was conducted by EPMA under a condition where an acceleration voltage was set to 15 kV so as to measure concentrations of Si, Mn, and Al in surfaces of the obtained steel sheets. As a result thereof, the concentrations of Si and Mn were 3.5% or less; however, the concentrations of Al matched the Al contents contained in the steel sheets. Therefore, it was difficult to find any relationship between the concentration of Al in the surface and superiority or inferiority of the chemical conversion processability.

This result is caused by the fact that in the analysis by EPMA, an average concentration is detected in an entirety of a region from an outermost surface of a steel sheet to a depth of substantially 3 μm. However, with regard to the concentration of Al, the present inventors assumed that there is any difference in a shallow region from the surface to a depth of 3 μm or less, and this difference has an effect on the chemical conversion processability.

It was considered that the using of a glow discharge emission spectroscopic analysis method (GDS) is optimal as a method which is capable of measuring concentration variations of a plurality of elements in a depth direction in a relatively short time with a high reliability. Therefore, an analysis was conduced by the GDS.

As a result thereof, although it will be described in detail in Examples, the present inventors found that there is a clear relationship between the superiority or inferiority of the chemical conversion processability (an amount of phosphate coating) and the maximum concentration of Al immediately below the surface which is obtained by a GDS.

In the case where the Al content is 0.3% or more, the superior chemical conversion processability was obtained even in the concentrations of Si and Mn where the chemical conversion processability was evaluated as inferior in Non-Patent Document 1, and the present inventors considered that this reason was due to production conditions. Under these circumstances, the above-described slabs were heated at various temperatures, and then rough rolling was performed at several rolling ratios. Next, descaling was performed, and then finish rolling was performed to produce hot-rolled steel sheets. The conditions of the finish rolling were the same as those described above.

The surfaces of the steel sheets after the finish rolling were observed. In addition, the produced hot-rolled steel sheets were subject to acid pickling, and then the surfaces of the steel sheets after the acid pickling were observed to confirm whether or not a hard-to-acid-pickle-portion (that is, a portion in which scales remain on the surface of the steel sheet) are present.

The acid pickling was performed by dipping the steel sheet in 3% HCl aqueous solution for 60 seconds that was maintained at 80° C. After the acid pickling, the steel sheet was sufficiently washed with water, and then was quickly dried.

Test specimens were collected from both of steel sheets in which hard-to-acid-pickle-portions were observed (referred to as hard-to-acid-pickle steel sheets) and steel sheets in which hard-to-acid-pickle-portions were not observed (referred to as normal steel sheets), and chemical conversion processability was evaluated. In addition, with regard to the hard-to-acid-pickle steel sheet, a portion in which the scales did not remain was used. As a result, it was proved that the chemical conversion processability of the hard-to-acid-pickle steel sheet is inferior to the chemical conversion processability of the normal steel sheet having the same composition.

Next, with respect to both of them (that is, both of the normal steel sheets after the acid pickling, and the portions of the hard-to-acid-pickle steel sheets after the acid pickling, in which the scales did not remain), surface elements were analyzed using a GDS; and thereby, an analysis was conducted in a region from the surface to a depth of 500 nm.

As a result, it was found that superior chemical conversion processability was obtained in the case where the maximum value of a concentration of Al that was concentrated in a surface layer was 0.75% or less. In addition, from a result of an analysis using an AES, it was confirmed that Al that is concentrated in the surface layer is present as $Al_2O_3$.

In addition, the occurrence of the hard-to-acid-pickle-portion was checked in the light of the slab heating temperature and a temperature at the end of the rough rolling (that is, a temperature at the start of the descaling) which was measured in advance; and thereby, a correlation was examined between whether or not the hard-to-acid-pickle-portion occurred and production conditions.

As a result thereof, it was found there is a relationship between the occurrence of the hard-to-acid-pickle-portion, and a combination of the slab heating temperature and the final temperature of the rough rolling. In addition, it was also found that there is a certain relationship between a temperature condition by which the hard-to-acid-pickle-portion did not occur and chemical components of the slab.

In the case where the slab heating temperature is set to be in a range of T1 or less described below, and the final temperature of the rough rolling is set to be in a range of T2 or less described below, it is possible to obtain a steel sheet in which hard-to-acid-pickle-portions do not occur and which is superior in chemical conversion processability. On the contrary, it was clear that in the case where it is out of the above-described temperature conditions, the chemical conversion processability is inferior. In addition, it was also clear that in the case where the chemical components are out of the ranges of the present embodiment, the chemical conversion processability is inferior even when the above-described temperature conditions are fulfilled.

$$T1=1215+35\times[Si]-70\times[Al]$$

$$T2=1070+35\times[Si]-70\times[Al]$$

In the equations, [Si] and [Al] represent a Si content (mass %) in the slab, and an Al content (mass %) in the slab, respectively.

The reasons are not necessarily clear why there is a relationship between whether or not the hard-to-acid-pickle-portion occurs and both of the upper limit of the slab heating temperature and the upper limit of the final temperature of the rough rolling that are calculated from the Si content and the Al content in the slab. However, the relationship is presumed as follows.

In the case where scales remain in the descaling process after the rough rolling, this portion in which the scales remain (a poorly descaled portion) becomes the hard-to-acid-pickle-portion in the acid pickling process after the finish rolling. Therefore, in the case where descaling property in the descaling process is superior, the hard-to-acid-pickle-portion hardly occurs in the acid pickling process, and the acid pickling property also becomes superior.

Both of Si and Al in the slab are easily oxidizable elements as compared to Fe, and particularly, it is widely known that Si deteriorates the descaling property (easiness of peeling off the scales) when the slab is heated to a predetermined temperature or more. However, in the case where Al is contained together with Si, Al has a tendency of being distributed between Si and an iron substrate. In particular, in the case where a Si content and an Al content are in ranges defined in the present embodiment described later, this tendency exhibits an operation of mitigating the decrease in descaling property due to Si scales. This operation is effective for a case in which the heating temperature is a low temperature that is not more than the temperature (T1) calculated from both of the Si content and the Al content.

In the case where the slab is heated at a low temperature that is not more than the temperature (T1) calculated from both of the Si content and the Al content and then the rough rolling accompanied with a temperature decrease with a given quantity is performed under a condition in which the rolling ratio is 80% or more, primary scales are crushed so as to be appropriate for the descaling. Therefore, even when heating is not performed particularly after the rough rolling, descaling (removal of the scales) is performed. In the case where the final temperature of the rough rolling is a low temperature that is not more than a predetermined temperature (T2), a problem does not occur in the descaling property. This reason is considered because a decreased amount of temperature during the rough rolling is reflected. That is, it is considered as follows. Since the decreased amount of temperature during the rough rolling is large, thermal stress caused by a variation in temperature occurs due to a difference between a thermal expansion coefficient of a steel and a thermal expansion coefficient of scales; and thereby, it becomes easy for the scales to be peeled off.

In experiments performed by the present inventors, it was also found that there is a relation ship between whether or not the hard-to-acid-pickle-portion occurs and a rough rolling ratio. This reason is not necessarily clear. However, as shown in Example 1 described later, it was found that a hot-rolled steel sheet can be produced in which hard-to-acid-pickle-portions do not occur in the case where a rough rolling ratio is set to be in a range of 80% or more.

In addition, as described above, in the experiments in which the chemical components and the production conditions were changed extensively, it was found that superior chemical conversion processability can also be obtained in the case where the chemical components and the production conditions are controlled in appropriate ranges described later and are combined. A relationship between the chemical conversion processability of the steel sheet after the hot-rolling and the acid pickling, and the Si content and the Al content is assumed as follows.

As is schematically illustrated in FIG. 1, in a surface of a steel after the acid pickling, oxides of composition elements such as Si, Mn, and Al are present in a portion of the surface within a thickness range of 200 to 500 nm, and C is concentrated in a remainder of the surface. In the case where oxides containing Al (considered as mainly $Al_2O_3$) are present in the surface of the steel at an amount of more than a predetermined amount described later, a wettability of chemical conversion processing liquid is poor; and thereby, it is considered that due to this, the chemical conversion processability is particularly deteriorated.

The present embodiment is completed on the basis of the above-described researches, and reasons of restricting the features of the present embodiment will be described below.

At first, chemical components of a steel sheet, a concentration of Al in the surface of the steel sheet will be described.

C: 0.05 to 0.12%

C is an essential element to secure strength of the steel sheet and to obtain a DP structure. In the case where the C content is less than 0.05%, a tensile strength of 780 MPa or more is not obtained. On the other hand, in the case where more than 0.12% of C is contained, a welding property is deteriorated. Therefore, the C content is set to be in a range of 0.05 to 0.12%. The C content is preferably in a range of 0.06 to 0.10%, and more preferably in a range of 0.065 to 0.09%.

Si: 0.8 to 1.2%

Since Si is an element that promotes a ferrite transformation, it is easy to obtain the DP structure by appropriately controlling the C content. However, Si strongly effects on properties of scales of a hot-rolled steel and the chemical conversion processability. In the case where the Si content is less than 0.8%, it is difficult to secure the ferrite phase. In addition, Si scales are partially generated (in a strip shape, or in a macular shape); and thereby, an exterior appearance is greatly deteriorated. On the other hand, in the case where the Si content is more than 1.2%, the chemical conversion processability is greatly decreased. Therefore, the Si content is set to be in a range of 0.8 to 1.2%. In addition, in the case where a particularly high hole expandability is required, it is preferable that the Si content is set to be in a range of 1.0% or more.

Mn: 1.6 to 2.2%

Mn is an essential element to secure the strength of the steel sheet, and Mn increases hardenability to allow the DP steel sheet to be easily produced. Therefore, it is necessary to contain 1.6% or more of Mn. On the other hand, in the case where the Mn content is more than 2.2%, there is a concern that ductility becomes inferior or properties of a sheared surface at the time of shearing are deteriorated due to segregation in a sheet thickness direction. Therefore, the upper limit of the Mn content is set to 2.2%. The Mn content is preferably in a range of 1.7 to 2.1%, and more preferably in a range of 1.8 to 2.0%.

Al: 0.3 to 0.6%

Al is an element that plays the most important role in the present embodiment together with Si. Al promotes the ferrite transformation. In addition, Al improves a configuration of the scales of the hot-rolled steel; and therefore, Al has an effect on the descaling after the rough rolling and the acid pickling property after the hot rolling. In the case where the Al content is less than 0.3%, the effect of improving the descaling property with respect to the Si scales is insufficient. On the other hand, in the case where the Al content is more than 0.6%, an Al oxide itself leads to the deterioration of the chemical conversion processability which is not preferable even in the case where the slab heating temperature and the rough rolling condition are set to be in ranges of the present embodiment. The Al content is preferably in a range of 0.35 to 0.55%.

P: 0.0005 to 0.05%

P functions as a solid-solution hardening (grain boundary hardening) element; however, since P is an impurity, there is a concern that workability may be deteriorated due to the segregation. Therefore, it is necessarily to set the P content to be in a range of 0.05% or less. The P content is preferably in a range of 0.03% or less, and more preferably in a range of 0.025% or less. On the other hand, in order to make the P content be less than 0.0005%, a great increase in cost is accompanied.

S: 0.0005 to 0.005%

S forms an inclusion such as MnS; and thereby, the mechanical properties are deteriorated. Therefore, it is preferable to reduce the S content as much as possible. However, a content of 0.005% or less of S may be permitted. On the other hand, in order to make the S content be less than 0.0005%, a great increase in cost is accompanied. The S content is preferably in a range of 0.004% or less, and more preferably in a range of 0.003% or less.

N: 0.0005 to 0.01%

N is an impurity, and N forms inclusions such as AlN; and thereby, there is a concern that N effects on workability. Therefore, the upper limit of the N content is set to 0.01%. The N content is preferably in a range of 0.0075% or less, and more preferably in a range of 0.005% or less. On the other hand, in order to make the N content be less than 0.0005%, a great increase in cost is accompanied.

In the hot-rolled steel sheet according to the present embodiment, the following elements may be contained as necessary.

Cu: 0.002 to 2.0%

Cu has an effect of improving a fatigue property; and therefore, Cu may be contained at a content in the above-described range.

Ni: 0.002 to 1.0%

Ni may be contained for the purpose of preventing hot brittleness in the case of containing Cu. Ni may be contained at a content that is a half of the Cu as a rough indication.

One or more selected from a group consisting of Ti: 0.001 to 0.5%, Nb: 0.001 to 0.5%, Mo: 0.002 to 1.0%, V: 0.002 to 0.2%, Cr: 0.002 to 1.0%, and Zr: 0.002 to 0.2%.

The above-described elements are effective for high-strengthening of the steel sheet due to solid-solution hardening and precipitation hardening, and the above-described elements may be contained as necessary. A content in which this effect becomes clear is set as the lower limit, and a content in which this effect is saturated is set as the upper limit.

Either one or both of Ca: 0.0005 to 0.0050% and REM: 0.0005 to 0.0200%.

Here, the REM is rare-earth metal and is one or more selected from a group consisting of Sc, Y, La, Ce, Pr, Nd, Pm, Sm, Eu, Gd, Tb, Dy, Ho, Er, Tm, Yb, and Lu.

These elements contribute to an improvement in the mechanical properties through a morphology control of non-metallic inclusions. This effect is recognized at a content of at least 0.0005% or more. In the case of Ca, the effect is saturated at a content of 0.0050%, and in the case of REM, the effect is saturated at a content of 0.0200%. Therefore, either one or both of Ca and REM may be contained at contents in the above-described ranges. With regard to each content, 0.0040% or less of Ca and 0.0100% or less of REM are preferable, and 0.0030% or less of Ca and 0.0050% or less of REM are more preferable.

B: 0.0002 to 0.0030%

B has a function of improving the mechanical properties through grain boundary hardening and a function of improving hardenability. Therefore, B is effective to secure martensite phases. This effect is recognized at a content of 0.0002% or more, and is saturated at a content of 0.0030%. Therefore, B may be contained at a content in the above-described range. The B content is preferably in a range of 0.0025% or less, and more preferably in a range of 0.0020% or less.

The maximum concentration of Al which is detected by a GDS in a region from a surface to a depth (thickness) of 500 nm after the acid pickling: 0.75% or less In the case where the above-described value is more than 0.75%, necessary chemical conversion processability is not obtained. The above-described value is preferably in a range of 0.65% or less. The lower limit is not particularly defined. Even when the value is not more than an average concentration of Al in the steel sheet, there is no problem.

In addition, in the present embodiment, a component other than the above-described components is Fe; however, unavoidable impurities included from melted materials such as scraps are permitted.

The GDS may be performed by a device available on the market under standard conditions. However, since the GDS is an analysis on an extreme surface layer, it is preferable that a taking-in cycle (sampling rate) be set to be short, and it is preferable that the taking-in period is set in a cycle shorter than 0.05 seconds/one time.

Next, a microstructure of the steel sheet will be described.

The microstructure of the hot-rolled steel sheet according to the present embodiment is basically a two-phase structure including ferrite phases and martensite phases. Specifically, the microstructure includes 60 area % or more of ferrite phases, more than 10 area % of martensite phases, and 0 to less than 1 area % of residual austenite phases, or the microstructure includes 60 area % or more of ferrite phases, more than 10 area % of martensite phases, less than 5 area % of bainite phases, and 0 to less than 1 area % of residual austenite phases.

In the case where the area ratio of the ferrite phases is set to be in a range of 60% or more, the area ratio of the martensite phases is set to be in a range of more than 10%, and the area ratio of the bainite phases is set to be in a range of 0 to less than 5%, a steel sheet can be obtained which has a tensile strength of 780MPa or more, an elongation of 23% or more, and a fatigue limit ratio of 0.45 or more. In addition, if the area ratio of the residual austenite phases, which is detected by an X-ray diffraction method, is in a range of 0 to less than 1%, this is permissible. The area ratio of the ferrite phases is preferably in a range of 70% or more, the area ratio of the martensite phases is preferably in a range of more than 12%, and the area ratio of the bainite phase is preferably in a range of less than 3%.

An average length of ferrite crystal grains in a rolling direction in a region from the surface of the steel sheet to a depth (thickness) of 20 μm: 20 μm or less.

In order to suppress occurrence of a surface deterioration at the time of press-forming, it is preferable that the average length in the rolling direction of the ferrite crystal grains which are present in a surface layer from the surface of the steel sheet to the depth (thickness) of 20 μm is in a range of 20 μm or less. In order to attain this property, as described later, it is effective to set the final temperature of the rough rolling to be in a range of 960° C. or less in order for austenite grains before the finish rolling not to be enlarged.

Next, a method for producing the steel sheet will be described.

The slab is produced through normal melting and casting. From a productivity aspect, continuous casting is preferable.

Heating Temperature (SRT): T1 or less

Rough Rolling Ratio (Rolling Reduction Ratio of Rough Rolling): 80% or more

Final Temperature of Rough Rolling: T2 or less

Here, T1 and T2 are values calculated from the following equations.

$$T1=1215+35\times[Si]-70\times[Al]$$

$$T2=1070+35\times[Si]-70\times[Al]$$

Here, [Si] and [Al] represent the Si content (mass %) in the slab, and the Al content (mass %) in the slab, respectively.

The slab is heated at a heating temperature in a range of T1 or less, and the slab is subjected to rough rolling under conditions in which a rolling reduction ratio is in a range of 80% or more and the final temperature is in a range of T2 or less to produce a rough rolled material.

The SRT effects on the descaling property after the rough rolling through a configuration of primary scales. In addition, the rough rolling ratio and the final temperature of the rough rolling are the most important factors that determine a crushed state of the primary scales, and these conditions effect on a descaled state after the rough rolling (whether or not a poorly descaled portion is present, or the like). The poorly descaled portion becomes the hard-to-acid-pickle-portion after the acid pickling; and as a result, the rough rolling ratio and the final temperature of the rough rolling effect on the acid pickling property after the finish rolling.

Particularly, in order to produce a steel sheet having superior resistance to surface deterioration during forming, it is preferable that the SRT is set to be in a range of less than 1200° C., and the final temperature of the rough rolling is set to be in a range of 960° C. or less. As specifically illustrated in Examples, in the case where the final temperature of the rough rolling is set to be in a range of 960° C. or less, a steel sheet can be obtained which is superior in the resistance to surface deterioration during forming. It is considered that this effect is obtained by refining austenite grain sizes before the finish rolling.

In addition, to set the SRT to be in a range of 1200° C. or more, and to set the final temperature of the rough rolling to be in a range of 960° C. or less, it is necessary to make an object to be rolled (a rough rolled material) residue on a production line after the rough rolling; and thereby, the productivity is extremely decreased. Therefore, the SRT is preferably in a range of less than 1200° C., and more preferably in a range of less than 1150° C. In addition, the final temperature of the rough rolling is preferably in a range of 960° C. or less, and more preferably in a range of 950° C. or less.

If the finish rolling described below can be terminated at 700° C. or more, the lower limit of the SRT and the lower limit of the final temperature of the rough rolling are not particularly limited. The lower limit of the SRT and the lower limit of the final temperature of the rough rolling are appropriately determined depending on a capability and a specification of a rolling facility that is capable of terminating the finish rolling at 700° C. or more.

The rough rolling ratio (the rolling reduction ratio of the rough rolling) is in a range of 80% or more, and preferably in a range of 82% or more.

All of these conditions are experimentally found, and a derivation method will be described in detail in Examples.

Descaling:

Next, the rough rolled material is subjected to descaling.

The descaling can be performed with a general purpose device. A hydraulic pressure, a water flow rate, a spray opening degree, a nozzle tilt angle, a distance between the steel sheet and the nozzle, or the like may be selected by a business operator similarly to a normal hot rolling. For example, 10 MPa of a hydraulic pressure, 1.5 liter/second of a water flow rate, a spray opening degree of 25°, a nozzle tilt angle of 10°, a vertical distance between the steel sheet and the nozzle of 250 mm, or the like may be selected.

Finish Temperature (FT): 700 to 950° C.

Subsequently, the finish rolling is performed under a condition in which a finish temperature is set within a range of 700 to 950° C. to produce a rolled sheet.

It is necessary to set the FT to be in a range of 700° C. or more. In the case where the FT is less than 700° C., coarse crystal grains are easily formed in the surface layer; and thereby, there is a concern that the fatigue property is deteriorated. In addition, even when the cooling conditions are devised, there is a fear that a sufficient ductility is not obtained. On the other hand, in the case where the FT is too high, grain sizes become coarse; and thereby, superior mechanical properties are not obtained, which is not preferable. Therefore, the upper limit of the FT is set to 950° C.

Particularly, in order to produce a steel sheet having a strength and a ductility which are superior in isotropy, it is preferable to set the FT to be in a range of 900° C. or less. In the case where the FT is set to be in a range of 900° C. or less, the ferrite transformation can be performed from a state in which strain energy accumulated at the time of rolling is as high as possible. Thereby, a steel sheet can be obtained which has a strength and a ductility that are more isotropic.

Cooling After Hot-Rolling:

After the hot rolling is completed, primary cooling is performed at an average cooling rate (CR1) of 5 to 90° C./s. A final temperature of the primary cooling (MT) is set to be in a range of 550 to 750° C.

In the case where the CR1 is set to be less than 5° C./s, productivity is deteriorated, which is not preferable. In addition, the crystal grains become coarse; and thereby, there is a concern that the mechanical properties are deteriorated. In the case where the CR1 is set to be more than 90° C./s, the cooling becomes nonuniform, which is not preferable.

In order to obtain a steel sheet having a smooth acid-pickled surface without deteriorating the productivity, the CR1 is preferably in a range of 50° C./s or more, and more preferably in a range of 60° C./s or more. It is preferable that the cooling is performed by water cooling, and in this case, the generation of scales after the rolling is suppressed and the acid pickling property is improved.

In the case where the MT is more than 750° C., coarse martensite phases may be formed; and thereby, there is a concern that the mechanical properties are deteriorated. On the other hand, in the case where the MT is less than 550° C., a necessary fraction ratio of the martensite phases are not be obtained; and thereby, there is a concern that the strength becomes insufficient. The MT is preferably in a range of 580 to 720° C.

Next, secondary cooling is performed at an average cooling rate (CR2) of 15° C./s or less. A final temperature of the secondary cooling (MT2) is set to be in a range of 450 to 700° C. An air cooling may be selected as the cooling means.

In the case where the CR2 is more than 15° C./s, or the MT2 is more than 700° C., the concentration of C in the austenite phase become insufficient; and thereby, there is a concern that martensite phases is formed, and a difference in strength between the martensite phase and the ferrite phase is small. As a result, there is a concern that a formability is deteriorated. In the case where the MT2 is less than 450° C., there is a concern that pearlite phases are generated. The CR2 is preferably in a range of 10° C./s or less, and the MT2 is preferably in a range of 480 to 680° C.

Subsequently, third cooling is performed at an average cooling rate (CR3) of 30° C./s or more. A final temperature of the cooling (CT) is set to be in a range of 250° C. or less. In the case where the CR3 is less than 30° C./s, the generation of pearlite can not be suppressed. In addition, in the case where the CT is more than 250° C., there is a concern that generated M phases are tempered.

In the case where the CR3 is too large, there is a concern that the cooling in the width direction and the rolling direction becomes nonuniform; and therefore, the upper limit is preferably set to 100° C./s. The CR3 is preferably in a range of 45 to 90° C./s, and the CT is preferably in a range of 200° C. or less.

The produced steel sheet after the cooling is coiled according to a normal method.

Acid Pickling:

Subsequently, the hot-rolled steel sheet after being cooled may be acid-pickled to remove the scales on the surface of the steel sheet.

The acid pickling is performed by dipping the steel sheet in an HCl aqueous solution that is maintained at 70 to 90° C. A concentration of HCl is set to be in a range of 2 to 10%, and a dipping time is set to be in a range of 1 to 4 minutes. In the case where the temperature is less than 70° C., or in the case where the concentration is less than 2%, a long dipping time is necessary; and thereby, production efficiency is deteriorated.

On the other hand, in the case where the temperature is more than 90° C., or the concentration of HCl is more than 10%, surface roughness after the acid pickling decreases, which is not preferable.

In the case where the dipping time is less than 1 minute, the removal of the scales becomes incomplete, which is not preferable. In addition, in the case where the dipping time is more than 4 minutes, the production efficiency is deteriorated.

After the acid pickling, there is a case where a chemical conversion process as a surface treatment of coating is performed after being undergone a process such as processing. According to the present embodiment, the hard-to-acid-pickle-portions do not occur, and a sound chemical conversion processed film can be formed.

EXAMPLES

Example 1

Slabs having chemical compositions described in Table 1 were heated, rough rolling was performed, descaling was performed, and subsequently finish rolling was performed. Conditions until the rough rolling are shown in Table 4. In addition, descaling conditions after the rough rolling and finish rolling conditions are shown in Tables 2 and 3, respectively. In Table 3, FT represents finish temperature, and CR1 to CR3 represent cooling rates in primary cooling to third cooling, respectively. MT1 and MT2 represent final temperatures of the primary cooling and the secondary cooling, respectively, and CT represents final temperature of the cooling.

The obtained hot-rolled steel sheets were acid-pickled. In the acid pickling, the steel sheets were dipped into a 3% HCl aqueous solution for 60 seconds which was maintained at 80° C. After the acid pickling, the steel sheets were sufficiently washed with water and were quickly dried. A surface of each of the steel sheets after the finish rolling was observed, and a surface of each of the steel sheet after the acid pickling was also observed. Thereby, it was confirmed whether or not the hard-to-acid-pickle-portion was present.

Test specimens were collected from both of steel sheets in which the hard-to-acid-pickle-portions were observed and steel sheets (referred to as normal steel sheets) in which the hard-to-acid-pickle-portions were observed. Then, the test specimens were subjected to chemical conversion process to evaluate chemical conversion processability.

In the chemical conversion process, a chemical conversion processing agent available on the market was used, and this chemical conversion processing agent was baked at 55° C. for 2 minutes to form a film. A target adhesion amount was set to 2 g/m$^2$. Here, preparation of a processing liquid, and a processing method were set in accordance with conditions recommended by a maker.

With regard to evaluation of the chemical conversion processability, a coated amount W of phosphoric salt was measured, and in the case where the coated amount W was in a range of 1.5 g/m$^2$ or more, this case was evaluated as "superior", and in the case where the coated amount W was in a range of less than 1.5 g/m$^2$, this case was evaluated as "inferior".

As a result, it was proved that the chemical conversion processability of the steel sheet in which the hard-to-acid-pickle-portion was observed was inferior to the chemical conversion processability of the normal the steel sheet with the same composition.

With regard to all the steel sheets, an analysis on surface elements was performed by a GDS after the acid pickling. This surface analysis was performed using JY5000RF manufactured by JOBIN YVON S.A.S. under conditions where an output was 40 W, an Ar fluid pressure was 775 Pa, and a sampling interval was 0.045 seconds.

Spectrum wavelengths of C, Si, Mn, and Al elements were 156 nm, 288 nm, 258 nm, and 396 nm, respectively. Concentrations of these elements were measured in a region from a surface to a depth (thickness) of 500 nm.

Here, in the steel sheet in which the hard-to-acid-pickle-portion (a portion in which scales remained) was generated, a sample for measurement was collected from a part (portion) in which the scales did not remain, and the Al content was measured by the GDS, and the chemical conversion processability was evaluated.

The obtained results are collectively shown in Tables 4 and 5.

Concentration profiles of these elements, and superiority or inferiority of the chemical conversion processability were examined. As a result thereof, a specific relationship was not found between the concentrations of three elements of C, Si, and Mn, and the superiority or inferiority of the chemical conversion processability. However, the concentration of Al and the superiority or inferiority of the chemical conversion processability had a correlation, and it was found that superior chemical conversion processability was obtained in a steel sheet in which the maximum concentration of Al was in a range of 0.75% or less.

In addition, the occurrence of the hard-to-acid-pickle-portion was compared to the slab heating temperature, and a temperature at the end of the rough rolling (that is, a temperature at the start of the descaling) that was measured in advance. Thereby, an examination was made with respect to a correlation between whether or not the hard-to-acid-pickle-portion occurs and production conditions. As a result, it was found that there is a relationship between the occurrence of the hard-to-acid-pickle-portion, and a combination of the slab heating temperature condition and the final temperature condition of the rough rolling. In addition, it was also found that there is a specific relationship between temperature conditions in which the hard-to-acid-pickle-portion does not occur and chemical components of the slab.

First, the slab heating temperature was examined.

Sample Nos. 1, 2, 4, 9, 13, 15, and 18 were selected in which the hard-to-acid-pickle-portion was not present, the chemical conversion processabilities were superior, and the maximum concentrations of Al were in a range of 0.75% or less. It was considered that the upper limit of the slab heating temperature may be obtained from actual values of these samples. Under this consideration, a relationship was examined in detail between the upper limit of the slab heating temperature and the chemical components.

It is known that C, Si, Mn, P, S, and Al have effects on formation of primary scales of a steel sheet. One or two elements were selected from these elements, and then a linear single regression analysis or a linear multiple regression analysis was performed, in which the concentration (mass %) thereof was set as an independent variable (X, or X1 and X2), and the slab heating temperature was set as a dependent variable (Y). That is, a and b in a relational expression of Y=aX+b, or c, d, and e in a relational expression of Y=cX1+dX2+e were obtained when the relational expression was established in a minimum error (residual sum of squares).

As a result, it was found that in the case where a combination of [Si] and [Al] was selected as the independent variable, the residual sum of squares becomes the minimum. That is, it was found that there is the strongest correlation between the upper limit of the slab heating temperature, and [Si] and [Al]. Here, calculation was performed by a calculation software available on the market.

The obtained regression equation was Y=1208+35[Si]−64[Al]. Fitting of c, d, and e was performed based on this equation, and T1=1215+35×[Si]−70×[Al] was obtained as a temperature equation in which all the conditions of the above-described seven samples were fulfilled.

Next, the final temperature of the rough rolling was examined.

With the same method as the slab heating temperature, the same Samples Nos. 1, 2, 4, 9, 13, 15, and 18 were selected. It was considered that the upper limit of the final temperature of the rough rolling may be obtained from actual values of these samples. Under this consideration, a relationship was examined in detail between the upper limit of the final temperature of the rough rolling and the chemical components.

As described above, with respect to C, Si, Mn, P, S, and Al, a single regression analysis was performed, and subsequently a multiple regression analysis was performed in which two elements were selected. As a result thereof, similarly to the slab heating temperature, it was found that in the case where a combination of [Si] and [Al] was selected as an independent variable, the residual sum of squares becomes the minimum.

The obtained regression equation was Y=1068+32[Si]−66[Al]. Fitting was performed based on this equation, and T2=1070+35×[Si]−70×[Al] was obtained as a temperature equation in which all the conditions of the above-described seven samples were fulfilled.

That is, it was concluded that in the case where the slab heating temperature is set to be in a range of T1 or less and the final temperature of the rough rolling is set to be in a range of T2 or less, a steel sheet in which hard-to-acid-pickle-portions do not occur and superior chemical conversion processability can be obtained.

It was clear that the chemical conversion processability is inferior in the case where either one or both of the slab heating temperature and the final temperature of the rough rolling are out of the above-described temperature conditions (Sample Nos. 3, 5, 7, 8, 11, 12, and 17), In addition, it was also clear that the chemical conversion processability is inferior in the case where the chemical components are out of the ranges defined in the present embodiment (Sample No. 6), even when the above-described temperature conditions are fulfilled.

On the other hand, even when the above-described temperature conditions are fulfilled, in the case where the rough rolling ratio is less than 80% (Sample Nos. 10 and 20), it is determined that scale crushing is perhaps insufficient; and thereby, the descaling property is inferior. As a result, the hard-to-acid-pickle-portion occurs and the chemical conversion processability is deteriorated.

Table 5 is continuous from Table 4, and Table 5 shows tensile strength ($\sigma_B$), elongation ($\epsilon_B$), a hole expansion limit (hole expandability) ($\lambda$), and a fatigue limit ratio.

The tensile strength and the elongation were measured in accordance with JIS Z 2241. In detail, a tensile test specimen of No. 5 of JIS Z 2201 was collected in a manner such that a direction orthogonal to a rolling direction becomes a longitudinal direction of the tensile test specimen. Then, a tensile force was applied in the longitudinal direction (in the direction orthogonal to the rolling direction) of the tensile test specimen, and the tensile strength and the elongation were measured.

In addition, the hole expansion limit was measured in accordance with JFST 1001-1996 of The Japan Iron and Steel Federation standard. Dimensions of the test specimen were 150×150 mm, and a size of a punched hole was 10 mmϕ. A punching clearance was 12.5%. Hole expansion was performed by using a conical punch of 60° from a shear surface side. Inner diameter d of a hole was measured when a crack penetrated through a sheet thickness. When inner diameter before the hole expansion was set to $d_0$, the hole expansion limit $\lambda$(%) was obtained from the following equation.

$$\text{Hole Expansion Limit } \lambda(\%)=(d-d_0)/d_0\times 100$$

The fatigue limit ratio was calculated from the following method. A test specimen of No. 1 (b=15 mm, R=30 mm) that is defined in JIS Z 2275 was collected in a manner such that a longitudinal direction thereof becomes parallel with a direction orthogonal to a rolling direction of the steel sheet. A plane bending fatigue test was performed at 25 Hz, and a S-N diagram was obtained on the basis of the obtained test result. In the obtained S-N diagram, strength at $1\times10^7$ times was defined as fatigue strength $\sigma_W$, and the fatigue limit ratio was calculated from the following equation.

$$\text{Fatigue Limit Ratio}=\sigma_W\sigma_B$$

From the above-described results, it was found that sufficient property can be obtained with respect to any property. With regard to the hole expandability, in the case where a Si content was set to be in a range of 1% or more, as shown in Sample Nos. 7 to 20, steel sheets were obtained in which the hole expandabilities were particularly superior.

TABLE 1

| Chemical Components | | | | | | | | |
|---|---|---|---|---|---|---|---|---|
| | Components (mass %) | | | | | | | |
| Slab | C | Si | Mn | P | S | Al | N | Remark |
| A | 0.090 | 0.85 | 1.96 | 0.010 | 0.0019 | 0.30 | 0.0017 | Present Invention |
| B | 0.090 | 0.90 | 2.02 | 0.009 | 0.0019 | 0.46 | 0.0017 | Present Invention |
| C | 0.091 | 0.97 | 2.02 | 0.021 | 0.0019 | 0.25 | 0.0022 | Comparative Example |
| D | 0.086 | 1.00 | 2.02 | 0.020 | 0.0021 | 0.35 | 0.0017 | Present Invention |
| E | 0.090 | 1.00 | 2.04 | 0.020 | 0.0018 | 0.40 | 0.0017 | Present Invention |
| F | 0.091 | 1.05 | 2.00 | 0.020 | 0.0019 | 0.45 | 0.0022 | Present Invention |
| G | 0.093 | 1.15 | 2.00 | 0.021 | 0.0018 | 0.30 | 0.0022 | Present Invention |

An underline represents component beyond a range defined in an embodiment.

TABLE 2

| Descaling conditions | | | | |
|---|---|---|---|---|
| Hydraulic pressure (MPa) | Water Flow Rate (l/s) | Spray Opening Degree (°) | Nozzle Tilt Angle (°) | Vertical Distance Between Steel Sheet and Nozzle (mm) |
| 10 | 1.5 | 25 | 10 | 250 |

TABLE 3

| Finish Rolling Conditions | | | | | | |
|---|---|---|---|---|---|---|
| FT (° C.) | CR1 (° C./s) | MT1 (° C.) | CR2 (° C./s) | MT2 (° C.) | CR3 (° C./s) | CT (° C.) |
| 860 | 72 | 630 | 8 | 593 | 71 | 65 |

TABLE 4

| No. | Slab | T1 (° C.) | T2 (° C.) | Slab Heating Temperature (° C.) | Rough Rolling Ratio (%) | Final Temperature of Rough Rolling (° C.) | Whether or not hard-to-acid-pickle portion is present | Maximum concentration of Al (mass %) | Superiority or Inferiority of Chemical Conversion Processability |
|---|---|---|---|---|---|---|---|---|---|
| 1 | A | 1224 | 1079 | 1220 | 80 | 1077 | Not Present | 0.55 | Superior |
| 2 | | | | 1220 | 85 | 1075 | Not Present | 0.53 | Superior |
| 3 | | | | 1210 | 85 | 1085 | Present | 0.88 | Inferior |
| 4 | B | 1214 | 1069 | 1210 | 85 | 1068 | Not Present | 0.70 | Superior |
| 5 | | | | 1200 | 80 | 1080 | Present | 0.91 | Inferior |
| 6 | C | 1231 | 1086 | 1230 | 85 | 1081 | Present | 0.92 | Inferior |
| 7 | D | 1226 | 1081 | 1250 | 80 | 1094 | Present | 0.98 | Inferior |
| 8 | | | | 1250 | 90 | 1069 | Present | 1.0 | Inferior |
| 9 | | | | 1220 | 85 | 1080 | Not Present | 0.74 | Superior |
| 10 | | | | 1220 | 75 | 1067 | Present | 0.99 | Inferior |
| 11 | E | 1222 | 1077 | 1230 | 85 | 1082 | Present | 1.18 | Inferior |
| 12 | | | | 1230 | 85 | 1070 | Present | 1.13 | Inferior |
| 13 | | | | 1215 | 85 | 1075 | Not Present | 0.59 | Superior |
| 14 | | | | 1160 | 80 | 1012 | Not Present | 0.68 | Superior |
| 15 | F | 1220 | 1075 | 1220 | 85 | 1072 | Not Present | 0.73 | Superior |
| 16 | | | | 1140 | 88 | 977 | Not Present | 0.71 | Superior |
| 17 | G | 1234 | 1089 | 1250 | 80 | 1051 | Present | 1.04 | Inferior |
| 18 | | | | 1230 | 80 | 1086 | Not Present | 0.62 | Superior |
| 19 | | | | 1155 | 85 | 1004 | Not Present | 0.54 | Superior |
| 20 | | | | 1130 | 76 | 995 | Present | 1.06 | Inferior |

An underline represents component beyond a range defined in an embodiment.

TABLE 5

| No. | Slab | Tensile Strength (MPa) | Elongation (%) | Hole Expandability (%) | Fatigue Limit Ratio | |
|---|---|---|---|---|---|---|
| 1 | A | 825 | 23.2 | 26 | 0.46 | Present Invention |
| 2 | | 829 | 23.4 | 25 | 0.47 | Present Invention |
| 3 | | 821 | 23.5 | 23 | 0.47 | Comparative Example |
| 4 | B | 822 | 23.4 | 29 | 0.46 | Present Invention |
| 5 | | 819 | 23.7 | 28 | 0.46 | Comparative Example |
| 6 | C | 830 | 22.1 | 37 | 0.43 | Comparative Example |

TABLE 5-continued

| No. | Slab | Tensile Strength (MPa) | Elongation (%) | Hole Expandability (%) | Fatigue Limit Ratio | |
|---|---|---|---|---|---|---|
| 7 | D | 829 | 23.4 | 50 | 0.49 | Comparative Example |
| 8 | | 829 | 23.5 | 51 | 0.49 | Comparative Example |
| 9 | | 822 | 23.9 | 53 | 0.48 | Present Invention |
| 10 | | 827 | 23.0 | 50 | 0.48 | Comparative Example |
| 11 | E | 828 | 23.2 | 52 | 0.49 | Comparative Example |
| 12 | | 830 | 23.3 | 53 | 0.49 | Comparative Example |
| 13 | | 831 | 23.0 | 51 | 0.49 | Present Invention |
| 14 | | 833 | 23.2 | 50 | 0.49 | Present Invention |
| 15 | F | 820 | 23.4 | 56 | 0.49 | Present Invention |
| 16 | | 816 | 23.0 | 57 | 0.48 | Present Invention |
| 17 | G | 832 | 23.6 | 53 | 0.46 | Comparative Example |
| 18 | | 835 | 23.4 | 53 | 0.47 | Present Invention |
| 19 | | 831 | 23.6 | 52 | 0.47 | Present Invention |
| 20 | | 827 | 23.9 | 54 | 0.46 | Comparative Example |

Example 2

Slabs having chemical components described in Table 6 were heated, rough rolling was performed, descaling was performed, and subsequently finish rolling was performed. Detailed conditions of the finish rolling are shown in Table 7, and conditions from the heating of the slab to the finish rolling are shown in Table 8. Descaling conditions were the same as Example 1.

The obtained hot-rolled steel sheets were acid-pickled under the same conditions as Example 1. A surface of each of the steel sheets after the finish rolling was observed, and a surface of the steel sheet after the acid pickling was also observed. Thereby, it was confirmed whether or not the hard-to-acid-pickle-portion was present.

Test specimens were collected from both of steel sheets in which the hard-to-acid-pickle-portions were observed and steel sheet in which the hard-to-acid-pickle-portions were not observed. Then, the chemical conversion processability was evaluated. Evaluation conditions and evaluation criteria were the same as Example 1.

The maximum value of the concentration of Al was measured using the GDS in a region from a surface of the steel sheet to a depth (thickness) of 500 nm.

In addition, the tensile strength, the elongation, the hole expansion limit, and the fatigue limit ratio were measured.

The obtained results are collectively shown in Tables 8 and 9.

With regard to the strength, the ductility, the hole expandability, and the fatigue property, any of the steel sheets exhibited preferable properties.

However, with regard to the acid pickling property and the chemical conversion processability, a difference depending on the rough rolling conditions was recognized. In detail, in Sample No. 22 in which the slab heating temperature was out of the range defined in the present embodiment, and Sample Nos. 24, 26, and 28 in which the final temperatures of the rough rolling were out of the range defined in the present embodiment, the hard-to-acid-pickle portions occurred. In addition, the chemical conversion processabilities were also inferior.

TABLE 6

| | Components (mass %) | | | | | | | | | | | | | | |
|---|---|---|---|---|---|---|---|---|---|---|---|---|---|---|---|
| Slab | C | Si | Mn | P | S | Al | N | Ti | Nb | V | Mo | Cu | Cr | Others | Remark |
| H | 0.10 | 0.80 | 1.60 | 0.008 | 0.0004 | 0.30 | 0.0035 | 0.05 | 0.010 | 0.15 | 0.2 | — | — | | Present Invention |
| I | 0.10 | 0.80 | 1.10 | 0.008 | 0.0004 | 0.11 | 0.0035 | 0.05 | 0.010 | 0.15 | 0.2 | — | — | | Comparative Example |
| J | 0.05 | 0.9 | 1.60 | 0.029 | 0.001 | 0.3 | 0.002 | — | — | — | — | 0.2 | — | Ni: 0.1 | Present Invention |
| K | 0.05 | 0.9 | 1.50 | 0.029 | 0.001 | 0.2 | 0.002 | — | — | — | — | 0.02 | — | | Comparative Example |
| L | 0.05 | 0.9 | 1.60 | 0.008 | 0.001 | 0.3 | 0.002 | — | — | — | — | — | 0.2 | | Present Invention |
| M | 0.05 | 0.9 | 1.50 | 0.008 | 0.001 | 0.2 | 0.002 | — | — | — | — | — | 0.2 | | Comparative Example |
| N | 0.05 | 0.9 | 1.60 | 0.027 | 0.001 | 0.3 | 0.002 | — | — | 0.02 | — | — | — | REM: 0.01 | Present Invention |
| O | 0.05 | 0.9 | 1.50 | 0.027 | 0.001 | 0.2 | 0.002 | — | — | 0.02 | — | — | — | REM: 0.01 | Comparative Example |
| P | 0.075 | 1.0 | 1.90 | 0.01 | 0.001 | 0.4 | 0.002 | — | — | — | — | — | — | Ca: 0.0015 | Present Invention |
| Q | 0.075 | 1.0 | 1.90 | 0.01 | 0.001 | 0.4 | 0.002 | — | — | — | — | — | — | B: 0.0010 | Present Invention |
| R | 0.075 | 1.0 | 1.90 | 0.01 | 0.001 | 0.4 | 0.002 | — | — | — | — | — | — | Zr: 0.1 | Present Invention |

An underline represents component beyond a range defined in an embodiment.

TABLE 7

| Symbol of Finish Rolling Condition | FT (° C.) | CR1 (° C./s) | MT1 (° C.) | CR2 (° C./s) | MT2 (° C.) | CR3 (° C./s) | CT (° C.) |
|---|---|---|---|---|---|---|---|
| #1 | 860 | 90 | 650 | 8 | 590 | 70 | 60 |
| #2 | 930 | 50 | 700 | 8 | 620 | 60 | 200 |
| #3 | 840 | 50 | 600 | 8 | 580 | 50 | 20 |

TABLE 8

| No. | Slab | T1 (° C.) | T2 (° C.) | Slab Heating Temperature (° C.) | Rough Rolling Ratio (%) | Final Temperature of Rough Rolling (° C.) | Finish Rolling Conditions | Whether or not hard-to-acid-pickle portion is present | Maximum concentration of Al (mass %) | Superiority or Inferiority of Chemical Conversion Processability |
|---|---|---|---|---|---|---|---|---|---|---|
| 21 | H | 1222 | 1077 | 1150 | 86 | 950 | #1 | Not Present | 0.64 | Superior |
| 22 | I | 1235 | 1090 | 1280 | 86 | 950 | #2 | Present | 0.81 | Inferior |
| 23 | J | 1226 | 1081 | 1150 | 86 | 950 | #1 | Not Present | 0.62 | Superior |
| 24 | K | 1233 | 1088 | 1200 | 86 | 1207 | #3 | Present | 0.79 | Inferior |
| 25 | L | 1226 | 1081 | 1150 | 86 | 950 | #1 | Not Present | 0.60 | Superior |
| 26 | M | 1233 | 1088 | 1200 | 86 | 1207 | #3 | Present | 0.77 | Inferior |
| 27 | N | 1226 | 1081 | 1150 | 86 | 950 | #1 | Not Present | 0.72 | Superior |
| 28 | O | 1233 | 1088 | 1200 | 86 | 1207 | #3 | Present | 0.84 | Inferior |
| 29 | P | 1222 | 1077 | 1150 | 86 | 950 | #1 | Not Present | 0.63 | Superior |
| 30 | Q | 1222 | 1077 | 1150 | 86 | 950 | #1 | Not Present | 0.60 | Superior |
| 31 | R | 1222 | 1077 | 1150 | 86 | 950 | #1 | Not Present | 0.66 | Superior |

An underline represents component beyond a range defined in an embodiment.

TABLE 9

| No. | Slab | Tensile Strength (MPa) | Elongation (%) | Hole Expandability (%) | Fatigue Limit Ratio | Remark |
|---|---|---|---|---|---|---|
| 21 | H | 898 | 23.0 | 39 | 0.45 | Present Invention |
| 22 | I | 970 | 17.3 | 38 | 0.44 | Comparative Example |
| 23 | J | 785 | 23.6 | 51 | 0.46 | Present Invention |
| 24 | K | 783 | 22.0 | 48 | 0.44 | Comparative Example |
| 25 | L | 788 | 23.9 | 50 | 0.47 | Present Invention |
| 26 | M | 780 | 23.5 | 49 | 0.45 | Comparative Example |
| 27 | N | 801 | 23.1 | 46 | 0.45 | Present Invention |
| 28 | O | 789 | 22.9 | 44 | 0.44 | Comparative Example |
| 29 | P | 806 | 23.6 | 56 | 0.46 | Present Invention |
| 30 | Q | 811 | 23.7 | 55 | 0.46 | Present Invention |
| 31 | R | 809 | 24.0 | 54 | 0.47 | Present Invention |

Example 3

Slabs having chemical components described in Table 10 were heated, rough rolling was performed, descaling was performed, and subsequently finish rolling was performed. Detailed conditions of the finish rolling are shown in Table 11, and conditions from the heating of the slab to the finish rolling are shown in Table 12. Descaling conditions after the rough rolling were the same as Example 1 (conditions shown in Table 2).

After the finish rolling, acid pickling was performed under the same conditions as Example 1, and it was confirmed whether or not the hard-to-acid-pickle portion was present. As a result thereof, the hard-to-acid-pickle portions were not observed in any steel sheet.

In addition, chemical conversion process was performed under the same conditions as Example 1, and the chemical conversion processability was evaluated. As a result thereof, all of the steel sheets were evaluated as "preferable (good)".

Similarly to Example 1, the maximum value (mass %) of the concentration of Al was measured using a GDS in a region from a surface of the steel sheet to a depth (thickness) of 500 nm. In addition, the tensile strength, the elongation, the hole expandability, and the fatigue limit ratio were measured.

The obtained results are shown in Tables 13. Here, $\sigma_{B\text{-}L}$ and $\epsilon_{B\text{-}L}$ represent tensile strength and elongation, respectively, which were measured in a manner such that a direction parallel with a rolling direction was set as a tensile direction. In addition, $\sigma_{B\text{-}C}$ and $\epsilon_{B\text{-}C}$ represent tensile strength and elongation, respectively, which were measured in a manner such that a direction orthogonal to the rolling direction was set as a tensile direction. As an index of an anisotropy based on these measured values, $\Delta\sigma_B=|\sigma_{B\text{-}L}-\sigma_{B\text{-}C}|$, and $\Delta\epsilon_B=|\epsilon_{B\text{-}L}-\epsilon_{B\text{-}c}|$ are shown in Table 11. These are values obtained by the same tensile test as Example 1.

In addition, an average length of ferrite crystal grains in the rolling direction was measured in a region from the surface of the steel sheet to a depth (thickness) of 20 μm, and the results thereof are shown in Table 11.

In Sample Nos. 2, 4, 6, 8, 11, 12, and 13 that were produced under conditions where final temperatures of the rough rolling were in a range of 960° C. or less and finish rolling temperatures were in a range of 900° C. or less, the anisotropies of the tensile strengths were in a range of 6 MPa or less, and the anisotropies of the elongations were in a range of 2% or less. As described above, it was found that the anisotropy of the tensile strength and the anisotropy of the elongation were small and the isotropies were superior. In addition, it was found that the average lengths of the ferrite crystal grains in the rolling direction were in a range of 20 μm or less in a region from the surface to the depth (thickness) of 20 μm, and the resistances to the surface deterioration during forming were superior.

On the other hand, in Sample Nos. 1, 5, and 9 in which the final temperatures of the rough rolling were more than 960° C., the average lengths of the ferrite crystal grains in the rolling direction were 30 μm or more in a region from the surface to the depth (thickness) of 20 μm, and there was a fear that the surface deterioration during forming occurred.

In addition, in Sample Nos. 3, 7, 9, and 10 in which the finish rolling temperature was more than 900° C., the anisotropies of the tensile strengths were 20 MPa or more, and the anisotropies of the elongations were 3.3% or more. As described above, since the anisotropy of the tensile strength and the anisotropy of the elongation are large, it is clear that a degree of freedom of collecting a blank for forming is strongly restricted.

TABLE 11

| Finish Rolling Conditions | | | | | | | |
|---|---|---|---|---|---|---|---|
| Symbol | FT (° C.) | CR1 (° C./s) | MT1 (° C.) | CR2 (° C./s) | MT2 (° C.) | CR3 (° C./s) | CT (° C.) |
| a | 907 | 72 | 630 | 8 | 598 | 71 | 65 |
| b | 898 | 60 | 680 | 7 | 645 | 65 | 40 |
| c | 875 | 55 | 625 | 8 | 594 | 60 | 60 |
| d | 845 | 50 | 645 | 7 | 614 | 70 | 55 |

TABLE 12

| No. | Slab | T1 (° C.) | T2 (° C.) | Slab Heating Temperature (° C.) | Rough Rolling Ratio (%) | Final Temperature of Rough Rolling (° C.) | Finish Rolling Conditions |
|---|---|---|---|---|---|---|---|
| 1 | H | 1227 | 1082 | 1196 | 80 | 965 | b |
| 2 | | | | 1195 | 80 | 955 | b |
| 3 | | | | 1190 | 80 | 955 | a |
| 4 | | | | 1195 | 80 | 955 | b |
| 5 | I | 1221 | 1076 | 1190 | 84 | 963 | b |
| 6 | | | | 1170 | 84 | 958 | b |
| 7 | | | | 1170 | 84 | 950 | a |
| 8 | | | | 1150 | 84 | 930 | c |
| 9 | J | 1209 | 1064 | 1130 | 85 | 980 | a |
| 10 | | | | 1130 | 84 | 950 | a |
| 11 | | | | 1130 | 84 | 945 | c |
| 12 | | | | 1130 | 85 | 930 | d |
| 13 | | | | 1130 | 85 | 915 | d |

TABLE 13

| No. | Slab | Maximum concentration of Al (mass %) | $\sigma_{B\text{-}L}$ (MPa) | $\sigma_{B\text{-}C}$ (MPa) | $\Delta\sigma_B$ (MPa) | $\epsilon_{B\text{-}L}$ (%) | $\epsilon_{B\text{-}C}$ (%) | $\Delta\epsilon_B$ (%) | Hole Expand-ability (%) | Fatigue Limit Ratio | Average length of ferrite crystal grains in rolling direction in region from surface of steel sheet to thickness of 20 μm (μm) |
|---|---|---|---|---|---|---|---|---|---|---|---|
| 1 | H | 0.64 | 820 | 829 | 9 | 24.7 | 23.6 | 1.1 | 52 | 0.46 | 32 |
| 2 | | 0.64 | 816 | 822 | 6 | 24.8 | 24.0 | 0.8 | 55 | 0.46 | 20 |
| 3 | | 0.63 | 833 | 853 | 20 | 23.1 | 18.9 | 4.2 | 51 | 0.46 | 18 |
| 4 | | 0.64 | 822 | 826 | 4 | 23.4 | 22.5 | 0.9 | 53 | 0.47 | 19 |
| 5 | I | 0.60 | 829 | 837 | 8 | 23.5 | 22.3 | 1.2 | 50 | 0.46 | 33 |
| 6 | | 0.59 | 831 | 835 | 4 | 23.6 | 22.6 | 1.0 | 51 | 0.48 | 20 |
| 7 | | 0.59 | 844 | 877 | 33 | 22.5 | 18.6 | 3.9 | 53 | 0.46 | 19 |
| 8 | | 0.61 | 826 | 831 | 5 | 25.4 | 23.8 | 1.6 | 55 | 0.48 | 17 |
| 9 | J | 0.56 | 853 | 883 | 30 | 22.4 | 18.8 | 3.6 | 52 | 0.46 | 36 |
| 10 | | 0.57 | 840 | 876 | 36 | 22.0 | 18.7 | 3.3 | 50 | 0.46 | 21 |
| 11 | | 0.57 | 827 | 833 | 6 | 23.7 | 22.8 | 0.9 | 53 | 0.47 | 20 |
| 12 | | 0.55 | 831 | 837 | 6 | 23.8 | 22.9 | 0.9 | 53 | 0.47 | 19 |
| 13 | | 0.56 | 829 | 831 | 2 | 25.4 | 24.8 | 0.6 | 51 | 0.47 | 17 |

TABLE 10

| Chemical Components | | | | | | | |
|---|---|---|---|---|---|---|---|
| | Components (mass %) | | | | | | |
| Slab | C | Si | Mn | P | S | Al | N |
| H | 0.070 | 1.05 | 1.92 | 0.010 | 0.0014 | 0.36 | 0.0019 |
| I | 0.075 | 1.00 | 1.93 | 0.012 | 0.0021 | 0.42 | 0.0019 |
| J | 0.080 | 1.01 | 1.94 | 0.012 | 0.0015 | 0.49 | 0.0016 |

INDUSTRIAL APPLICABILITY

According to an aspect of the present invention, a high strength hot-rolled steel sheet can be provided which is superior in an acid pickling property, a chemical conversion processability, a fatigue property, a hole expandability, and a resistance to surface deterioration during forming, and which has isotropic strength and isotropic ductility. Particularly, since the chemical conversion processability is superior, a plating layer or a coating film that is superior in an adhesion property can be formed on the surface of the steel sheet; and thereby, a superior corrosion resistance can be attained. Therefore, a thickness of a sheet that is used can be reduced through a reduction in the corrosion allowance, or the like; and thereby, the steel sheet can contribute to a mass-reduction of a vehicle.

In addition, since the hole expandability is superior, a restriction in a processing process is small and an applicable range of the steel sheet is wide. Since the mechanical properties of the steel sheet are less anisotropic and are isotropic, the collection of a blank at the time of processing can be performed with a good yield ratio. As described above, since a formability is superior, this steel sheet can be processed to components having various shapes even though the steel sheet has a high strength. In addition, since the fatigue property is also superior, the steel sheet can be applied to members such as underbody components to which stress is repeatedly applied.

In addition, since the crystal grains in the surface layer are prevented from being too long in the rolling direction, the occurrence of the surface deterioration after forming can be suppressed. Furthermore, due to improvement in the acid pickling property, a steel sheet having a smooth acid-pickled surface can be obtained without deteriorating the productivity.

Therefore, the high strength hot-rolled steel sheet according to an aspect of the invention is widely applicable to members for a transport machine such as an automobile; and therefore, the steel sheet can contribute a mass-reduction of the transport machine. As a result, the steel sheet can greatly contribute to industries.

The invention claimed is:

1. A high strength hot-rolled steel sheet that is superior in an acid pickling property, a chemical conversion processability, a fatigue property, a hole expandability, and a resistance to surface deterioration during forming, and that has isotropic strength and isotropic ductility, the steel sheet consisting of, in terms of percent by mass:

C: 0.05 to 0.12%;
Si: 1.0 to 1.2%;
Mn: 1.6 to 2.2%;
Al: 0.30 to 0.6%;
P: 0.05% or less;
S: 0.005% or less;
N: 0.01% or less; and
the remainder of Fe and unavoidable impurities, wherein a microstructure comprises: 60 area % or more of ferrite phases; more than 10 area % of martensite phases; and 0 to less than 1 area % of residual austenite phases, or the microstructure comprises: 60 area % or more of ferrite phases; more than 10 area % of martensite phases; less than 5 area % of bainite phases; and 0 to less than 1% of residual austenite phases, and a maximum concentration of Al detected by a glow discharge emission spectroscopic analysis is in a range of 0.75 mass % or less in a region from a surface of the steel sheet to a thickness of 500 nm after being acid-pickled.

2. A high strength hot-rolled steel sheet that is superior in an acid pickling property, a chemical conversion processability, a fatigue property, a hole expandability, and a resistance to surface deterioration during forming, and that has isotropic strength and isotropic ductility, the steel sheet consisting of, in terms of percent by mass:

C: 0.05 to 0.12%;
Si: 1.0 to 1.2%;
Mn: 1.6 to 2.2%;
Al: 0.30 to 0.6%;
P: 0.05% or less;
S: 0.005% or less;
N: 0.01% or less;
one or more selected from a group consisting of
Ni: 0.002 to 1.0%,
Ti: 0.001 to 0.5%,
Nb: 0.001 to 0.5%,
Mo: 0.002 to 1.0%,
V: 0.002 to 0.2%,
Cr: 0.002 to 1.0%,
Zr: 0.002 to 0.2%,
Ca: 0.0005 to 0.0050%,
REM: 0.0005 to 0.0200%, and
B: 0.0002 to 0.0030%; and
the remainder of Fe and unavoidable impurities, wherein a microstructure comprises: 60 area % or more of ferrite phases; more than 10 area % of martensite phases; and 0 to less than 1 area % of residual austenite phases, or the microstructure comprises: 60 area % or more of ferrite phases; more than 10 area % of martensite phases; less than 5 area % of bainite phases; and 0 to less than 1% of residual austenite phases, and a maximum concentration of Al detected by a glow discharge emission spectroscopic analysis is in a range of 0.75 mass % or less in a region from a surface of the steel sheet to a thickness of 500 nm after being acid-pickled.

3. The high strength hot-rolled steel sheet that is superior in an acid pickling property, a chemical conversion processability, a fatigue property, a hole expandability, and a resistance to surface deterioration during forming, and that has isotropic strength and isotropic ductility according to claim 1, wherein an average length of ferrite crystal grains in a rolling direction is in a range of 20 μm or less in a region from the surface of the steel sheet to a thickness of 20 μm.

4. The high strength hot-rolled steel sheet that is superior in an acid pickling property, a chemical conversion processability, a fatigue property, a hole expandability, and a resistance to surface deterioration during forming, and that has isotropic strength and isotropic ductility according to claim 2, wherein an average length of ferrite crystal grains in a rolling direction is in a range of 20 μm or less in a region from the surface of the steel sheet to a thickness of 20 μm.

5. A high strength hot-rolled steel sheet that is superior in an acid pickling property, a chemical conversion processability, a fatigue property, a hole expandability, and a resistance to surface deterioration during forming, and that has isotropic strength and isotropic ductility, the steel sheet comprising, in terms of percent by mass:

C: 0.05 to 0.12%;
Si: 1.0 to 1.2%;
Mn: 1.6 to 2.2%;
Al: 0.30 to 0.6%;
P: 0.05% or less;
S: 0.005% or less; and
N: 0.01% or less,
with the remainder being Fe and unavoidable impurities, wherein a microstructure comprises: 60 area % or more of ferrite phases; more than 10 area % of martensite phases; and 0 to less than 1 area % of residual austenite phases, or the microstructure comprises: 60 area % or more of ferrite phases; more than 10 area % of martensite phases; less than 5 area % of bainite phases; and 0 to less than 1% of residual austenite phases, and a maximum concentration of Al detected by a glow discharge emission spectroscopic analysis is in a range of 0.75 mass % or less in a region from a surface of the steel sheet to a thickness of 500 nm after being acid-pickled.

6. The high strength hot-rolled steel sheet that is superior in an acid pickling property, a chemical conversion processability, a fatigue property, a hole expandability, and a resistance to surface deterioration during forming, and that has isotropic strength and isotropic ductility according to claim 5, wherein the steel sheet further comprises, in terms of percent by mass:

one or more selected from a group consisting of

Cu: 0.002 to 2.0%,

Ni: 0.002 to 1.0%,

Ti: 0.001 to 0.5%,

Nb: 0.001 to 0.5%,

Mo: 0.002 to 1.0%,

V: 0.002 to 0.2%,

Cr: 0.002 to 1.0%,

Zr: 0.002 to 0.2%,

Ca: 0.0005 to 0.0050%,

REM: 0.0005 to 0.0200%, and

B: 0.0002 to 0.0030%.

* * * * *